United States Patent [19]

Vallée

[11] 4,138,935

[45] Feb. 13, 1979

[54] VENTILATOR

[76] Inventor: Louis L. Vallée, 6392 Maubourg Ave., Montreal, Quebec, Canada, H1M 2C8

[21] Appl. No.: 832,644

[22] Filed: Sep. 12, 1977

[30] Foreign Application Priority Data

Oct. 13, 1976 [CA] Canada ..... 263315

[51] Int. Cl.[2] ..... F24F 7/02; F24F 13/02

[52] U.S. Cl. ..... 98/42 A

[58] Field of Search ..... 98/42 A, 42 R, 37, 32, 98/DIG. 6; 52/198, 199, 200

[56] References Cited

U.S. PATENT DOCUMENTS

| | | | |
|---|---|---|---|
| 2,030,388 | 2/1936 | Muirhead et al. | 98/42 A |
| 2,625,094 | 1/1953 | Bonforte | 98/42 A |
| 3,238,862 | 3/1966 | Smith et al. | 98/42 A |
| 3,862,529 | 1/1975 | Markos | 98/42 R |

FOREIGN PATENT DOCUMENTS

| | | | |
|---|---|---|---|
| 110273 | 1917 | United Kingdom | 98/42 A |
| 811280 | 4/1959 | United Kingdom | 98/42 A |

*Primary Examiner*—H. Hampton Hunter

*Attorney, Agent, or Firm*—Larson, Taylor and Hinds

[57] ABSTRACT

A ventilator for use with sheet metal roofing.

The sheet metal panels covering the roof are lap-joined at the ridge of the roof and a ventilator opening is cut in the overlapped end portions of the sheet metal panels and in the underlying roof structure on either side of the ridge of the roof. The ventilator consists of a base member which is secured to the roof and a cover member which fits over the base member, both members being formed from sheet metal panels. The sheet metal panel from which the base member is formed has a centrally located cut-out conforming to the size of the opening in the roof structure and has its side edge portions folded upwards and inwards upon themselves to form flanges, and are further folded upwards at right angles to the flanges to form upstanding side walls. The end portions of the base sheet metal panel are folded to form curved windbreakers projecting outwardly between the ends of the upstanding side walls and are further folded to provide baffle walls extending between the side walls at a location close to the centrally located cut-out. The sheet metal panel from which the cover member is formed has its side portions bent downwards at right angles to the plane of the sheet and the edge portions are then folded inwards and upwards to form reinforced side walls, while the end portions of the panel are folded downwards and inwards to form angled deflectors. A second baffle is fitted to the under side of the cover member with the baffle portion being located in outward spaced apart location with respect to the baffles in the base member.

Both the base member and the cover member are bent transversely midway of their length to conform with the roof angle on either side of the roof ridge and when assembled, the angled deflectors of the cover member are spaced outwardly of the windbreakers of the base member.

9 Claims, 15 Drawing Figures

24
17
29
13
22
21
26
25
27
24
5
10
29
28
17
A
13a
19
21
22
13
4
A
24
25

26
13a
25
19
10
21
22
13
17
5
8

VENTILATOR

This invention relates to ventilators for the roofs of buildings and particularly for buildings having sheet metal roofing.

The present invention consists of two basic elements, a base member and a cover member, both formed from sheets of metal. The base member sheet has corner portions cut out to provide side and end portions about a central area of the sheet. The side portions are folded upwards at right angles to form side walls and the end portions are folded upwards and inwards to provide end wind breakers and internal baffles, with the wind breakers and baffles extending the full width between the side walls. Both the side walls and the baffles are disposed in spaced relation to a central rectangular opening which coincides with a cut-out in the underlying roof structure, with the central opening being fitted with a screen.

The cover member sheet has corner portions cut out to provide side and end portions about a central area of the sheet. The side portions are folded downwards and then upwards to form the side walls of the cover, while the end portions are folded downwards at an angle and then upwards and inwards to form end air deflectors which, when the cover is fitted onto the base member, cooperate with the wind breakers of the base member to provide end offset air passages to the ventilator. The cover member includes a pair of angled baffle inserts which, when interlocked with the side walls of the cover and with the wind breakers and baffles of the base member, form labyrinth air passages between the ends of the ventilator and the screened central openings in the base member.

A primary object of the invention is to provide a ventilator for use in the roofs of buildings in which the ventilator consists of a base member and a cover member, each formed from a sheet of metal.

A further object of the invention is to provide a ventilator having a base member and a cover member, with the base member having end wind breakers and internal baffles, and the cover member having end air deflectors and internal baffles all combining to provide labyrinth air passages between a central roof opening and the open ends of the ventilator.

These and other objects of the invention will be apparent from the following detailed specification and the attached drawings in which.

Figure 1:
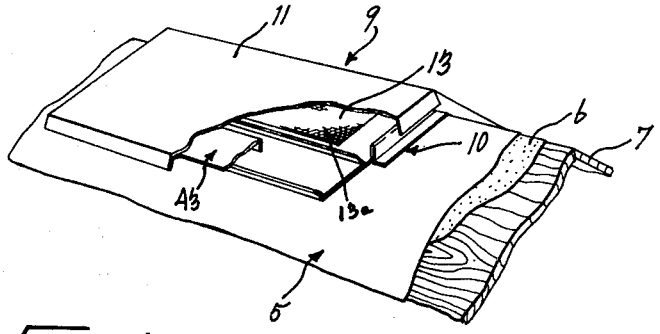
FIG. 1 is a perspective view of a portion of a roof structure showing a ventilator according to the present invention located at the ridge of the roof with a part of the cover of the ventilator broken away.

Referring to the drawings and particularly to FIGS. 1 to 6, the sheet metal roofing 5 is laid over a layer of waterproof material such as tar paper 6 which, in turn, is laid over the roof under structure 7. These elements have a cut-out 8 straddling the ridge of the roof and the dimensions of the cut-out 8 conform with the opening in the base member of the ventilator as will be explained.

The ventilator 9 comprises a base member 10 and a cover member 11.

The base member 10 of the ventilator 9 is formed from the sheet of metal 12 which has a centrally located cut-out 13 coinciding with the cut-out 8 in the underlying roof structure. A screen **13*a* is fitted over the cut-out 13**.

Figure 2:
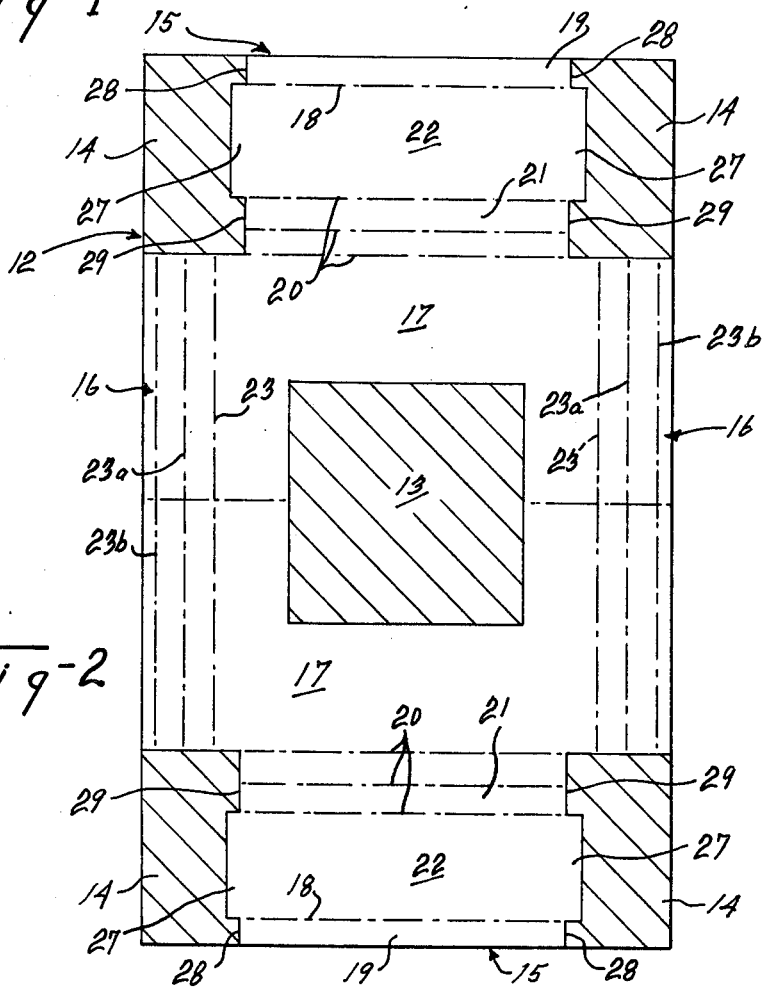
FIG. 2 is a top plan view of the sheet of metal from which the base member of the ventilator is formed.

The sheet of metal 12 has its corner portions 14, shown shaded in FIG. 2, cut out and discarded to provide two end portions 15 and two side portions 16 disposed about a central area 17 of the sheet 12.

Figures 3, 4, 5, 6:
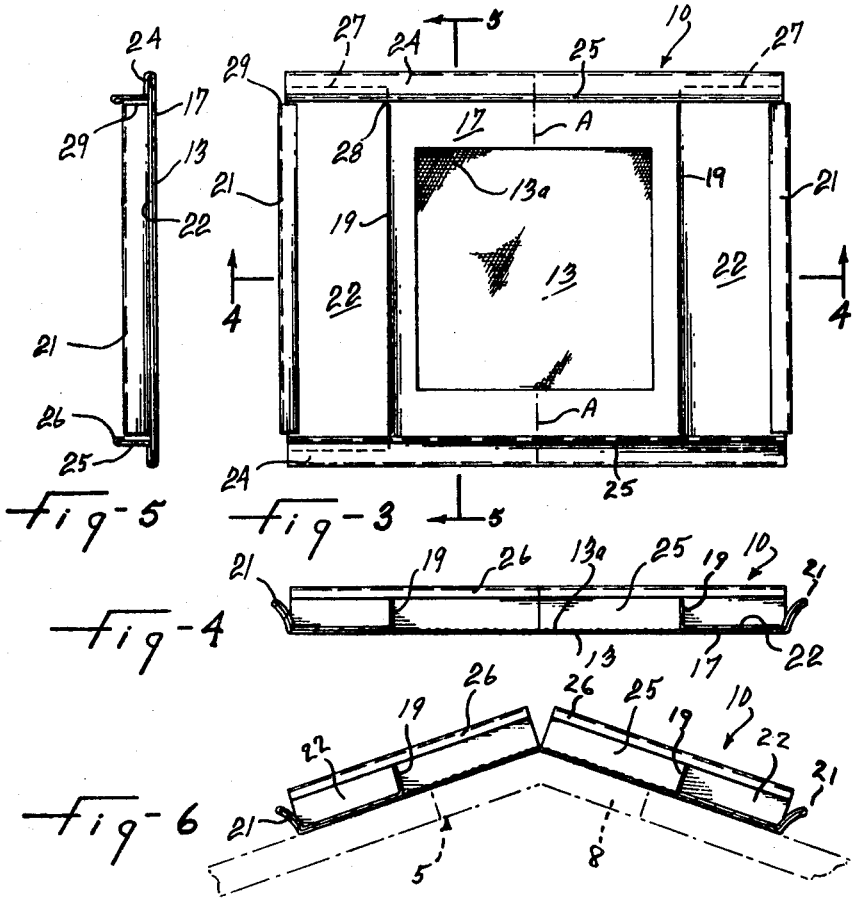
FIG. 3 is a top plan view of the base member of the ventilator as formed from the sheet shown in FIG. 2.
FIG. 4 is a longitudinal section taken on the line 4—4 of FIG. 3.
FIG. 5 is a transverse section taken on the line 5—5 of FIG. 3.
FIG. 6 is a longitudinal section similar to FIG. 4, bent along the line A—A in FIG. 3 to conform to the ridge of the roof to which the ventilator is fitted, showing in outline the underlying roof structure.

The two end portions 15 of the sheet 12 are each folded at right angles along the lines 18 to form the baffles 19 and are further folded along the lines 20 to form wind breakers 21, the baffles 19 and the wind breakers 21 being separated from each other by the flat portions 22 of the sheet, with these flat portions lying flat against the upper surface of the central area 17 of the sheet on opposite sides of the cut-out 13. The baffles 19 are folded upwards at right angles to the portion 22 of the sheet and are spaced outwardly from the adjacent edge of the cut-out 13, as shown in FIG. 3. The wind breakers 21 of double wall thickness are curved upwardly and outwardly as shown in FIG. 4.

The side portions 16 of the sheet 12 are each folded upwardly and inwardly along the lines 23 to form the double wall base flanges 24, then folded upwards at right angles along the lines **23*a* to form the side walls 25. The upper edge portions of the side walls 25 are then folded inwardly and downwardly upon themselves along the lines 23*b* to form the reinforced edge 26** of the side walls.

When the base member 10 is being formed, as shown in FIGS. 3, 4 and 5, the edge portions 27 projecting outwardly from the flat portions 22 fit between the double walls of the side base flanges 24 and the ends of the baffles 19 fit tightly against the inner surface of the side walls 25 and under the lower edge of the folded down reinforcing portion 26 of the side walls 25.

The wind breakers 21 which are double walled and curve upwardly and outwardly of the ends of the ventilators have their ends 29 fitted tightly against the inner surface of the side walls 25 and under and outwardly of the lower edge of the folded down reinforcing portion 26 of the side walls 25.

Figure 7:
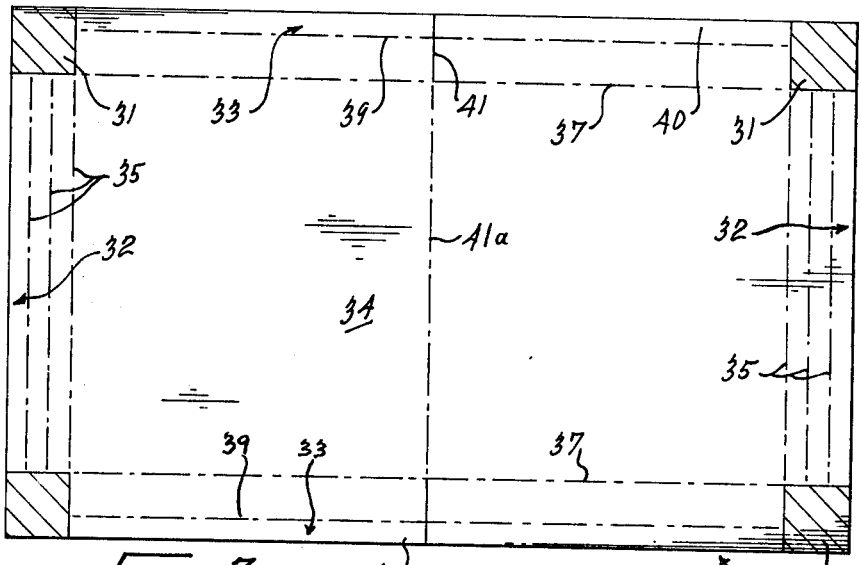
FIG. 7 is a top plan view of the sheet of metal from which the cover member of the ventilator is formed.
Figure 8:
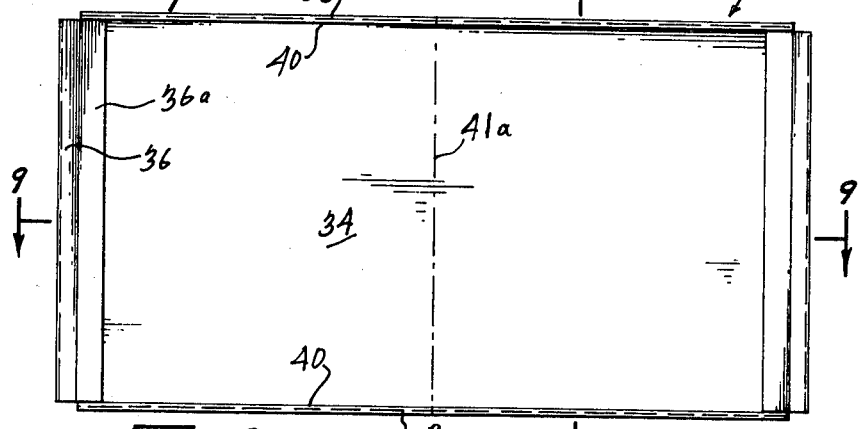
FIG. 8 is a bottom plan view of the cover member as formed from the sheet shown in FIG. 7.
Figure 9:
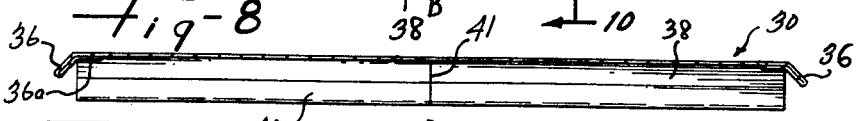
FIG. 9 is a longitudinal section taken on the line 9—9 of FIG. 8.
Figure 11:
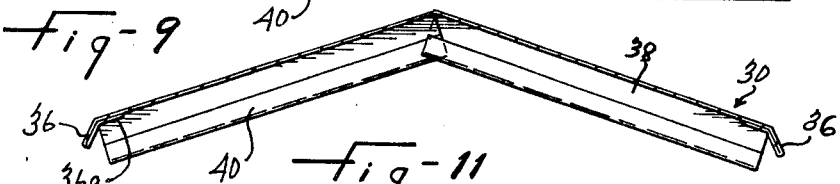
FIG. 11 is a longitudinal section similar to FIG. 9, bent along the line B—B in FIG. 8 to enable the cover member to fit on the base member shown in FIG. 6.

The cover member 11 of the ventilator is formed from the sheet of metal 30 shown in FIG. 7. The corner shaded portions 31 of the sheet are cut out and discarded to provide two end portions 32 and two side portions 33 projecting from the central area 34 of the sheet.

The end portions 32 of the sheet 30 are folded downwardly and inwardly along the lines 35 to form air deflectors 36 disposed at approximately 45° to the plane of the top surface of the cover 11. The side portions 33 of the sheet are folded downwardly along the lines 36 to form the side walls 38 of the cover 11 and the lower edge portions of the side walls 38 are folded inwardly and upwards along the lines 39 to lie against the inner surface of the side walls 38 to form a reinforcement 40 to the side walls.

The side walls 38–40 of the cover are slit along the lines 41 to enable the cover 11 to be folded along the chain dot line **41*a* in order to fit over the base member 10. The overlap of the side walls 38–40, where slit at 41**, are soldered or otherwise secured in order to hold the cover in its angled shape form and to make the overlap weatherproof.

A pair of baffles 42 are fitted on the under side of the cover member 11. These baffles 42 are cut and formed from the sheet of metal 43 shown in FIG. 12. The shaded corners 44 are cut out and discarded and the one edge portion 45 is folded at right angles along the line 46 to the main portion 47 of the sheet. The two edge portions 48 are also folded at right angles along the lines 49 of the sheet 43.

Figures 10, 11, 12, 13, 14, 15:
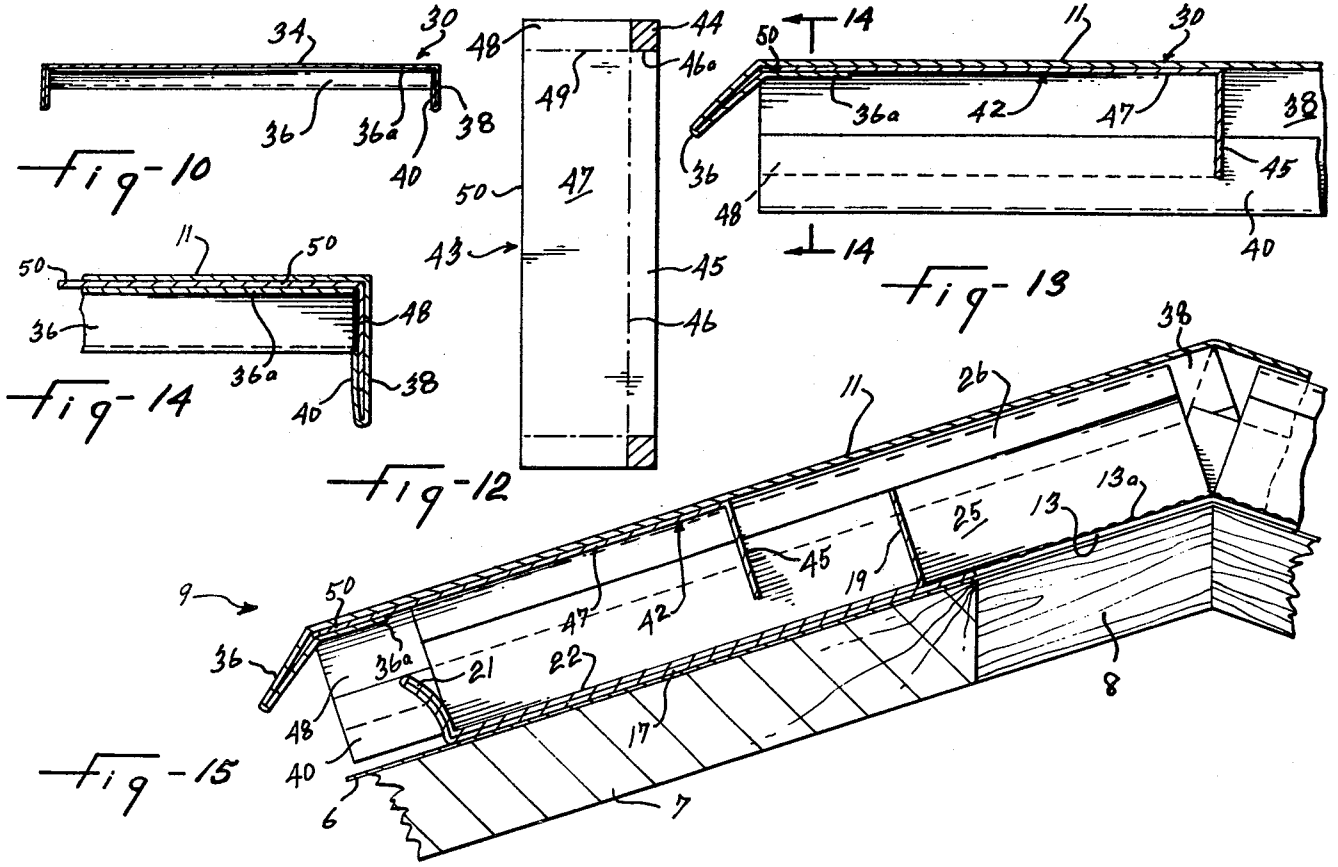
FIG. 10 is a transverse section taken on the line 10—10 of FIG. 8.
FIG. 12 is a top plan view of the sheet of metal from which the insert baffles of the cover member are formed.
FIG. 13 is an enlarged partial longitudinal section of one end of the cover member showing the baffle formed from the sheet shown in FIG. 12, fitted in place in the cover member.
FIG. 14 is a partial vertical section taken on the line 14—14 in FIG. 13.
FIG. 15 is a longitudinal section of the combined base and cover members showing the relationship of the baffles, air deflectors and wind breakers on one side of the ventilator.

The enlarged FIGS. 13 and 14 of one end portion of the cover 11 show the baffle 42 in sliding fit in the under side of the cover. The edge portions 48 of the baffle 42 are a sliding fit between the side walls 38 and the upturned reinforcement 40, and the edge portion 50 is in sliding engagement between the top of the cover and the inward projecting portion **36*a* of the air deflectors 36. The outer ends 51 of the downturned end 45 of the baffle 42 fit tightly against the inner facing surface of the reinforcing portion 40 of the side walls 38**.

While the baffle 42, shown in FIGS. 13 and 14, is a separate member of the ventilator, it is to be understood that it can be formed as an extension of the portion **36*a* of the air deflector 36**.

The above described ventilator has a low profile when fitted to straddle the ridge of a sheet metal roof and presents a minimum of structure on the roof which would be affected by mechanical or high wind forces. The strong side walls of the base member and cover member combined with the transverse baffles, air deflectors and wind breakers ensure a tight fit of the cover on the base member to resist separation of the cover from the base without the use of fasteners between them.

With the base member and cover member with its fitted baffles formed from only three sheets of metal without the use of fasteners between them, a strong and durable ventilator is formed at a minimum of expense and discarded sheet material.

The embodiments of the invention in which an exclusive property or privilege is claimed are defined as follows:

1. A ventilator for roofs wherein the roof has a ventilator opening; the said ventilator including a base member and a cover member fitted over the base member; the base member having double-walled side base flanges and inwardly disposed, upstanding longitudinal side walls, a wind breaker at each end and extending between the side walls, a baffle located inwardly of each of said wind breakers, an upper base wall joining one wind breaker and baffle at each end and lying on a lower base wall, the side edges of the upper base wall extending between the walls of the side base flanges and a screened ventilator opening in the lower base wall located centrally between the baffles; the cover member having downturned longitudinal side walls adapted for close fit on the outer surface of the side walls of the base member, an air deflector at each end and extending between the side walls of the cover member, baffles spaced inwardly of the air deflectors and extending between the side walls of the cover member; the said wind breakers and air deflectors together providing restricted openings to the ends of the ventilator, and the baffles of the basemember and cover member together forming a labyrinth passage between the restricted end openings of the ventilator and the screen ventilator opening in the basemember.

2. A ventilator as claimed in claim 1 wherein the base and cover members are bent transversely midway their length to allow the ventilator to be mounted on the ridge of a roof.

3. A ventilator as claimed in claim 1 in which the wind breakers formed in the base member are of double wall thickness and are curved upwardly and outwardly to a height less than the height of the adjacent side walls of the base member.

4. A ventilator as claimed in claim 1 in which the upstanding side walls of the base member have their upper edge portion folded inwardly and downwardly, and the outer ends of the baffles of the base member fit under and are held secure by the downwardly folded edge portion of the side walls.

5. A ventilator as claimed in claim 1 in which the air deflectors each have a portion projecting beyond the ends of the cover side walls, the deflectors bent downwardly from the plane of the top surface of the cover.

6. A ventilator for roofs wherein the roof has a ventilator opening, the said ventilator opening having a base member and a cover member fitted over the base member, the said base member formed from a first sheet of metal with opposing side portions of the sheet being folded upon themselves to form double-walled side base flanges and inwardly disposed, upstanding side walls, opposing end portions of the sheet being folded inwardly on themselves to form outwardly disposed wind breakers and inwardly disposed baffles, the side edges of the inwardly folded end portions, between the breakers and baffles, extending between the walls of the base flanges, that portion of the base sheet between the said inwardly disposed baffles having a cut out opening corresponding to the ventilator opening in the roof; the said cover member being formed from a second sheet of metal, opposing end portions of the sheet being folded downwardly and inwardly on themselves to form air deflectors, opposing side portions of the sheet being folded downwardly and then upwardly from the deflector, the air deflectors and wind breakers together providing restricted openings at each end of the ventilator, and the baffles on the base and cover together forming a labyrinth passage between each restricted end opening and the cut out opening in the base.

7. A ventilator as claimed in claim 6 wherein the baffles in the cover are each formed by a separate baffle member engaging with the inwardly folded end portions of the cover sheet and the upwardly folded side portions of the cover sheet.

8. A ventilator as claimed in claim 6 wherein each cover baffle is formed from a rectangular sheet of metal in which opposing end portions and one longitudinal edge portion, are bent at right angles to the plane of the main portion, the opposing end portions fitting between the downward and upwardly fold side portions of the cover and the other edge portion of the baffle sheet fitting between the inwardly folded end portions of the cover.

9. A ventilator as claimed in claim 6 wherein each cover end portion, forming an air deflector, extends inwardly to lie against the under surface of the cover member, each baffle on the cover member secured between the inwardly extended end portion and the under surface of the cover member.

* * * * *